US008677777B2

(12) United States Patent
Yamaguchi et al.

(10) Patent No.: US 8,677,777 B2
(45) Date of Patent: Mar. 25, 2014

(54) FLOW-DOWN-TYPE ICE MAKING MACHINE

(75) Inventors: Hiroki Yamaguchi, Toyoake (JP); Yuji Wakatsuki, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 744 days.

(21) Appl. No.: 12/227,324

(22) PCT Filed: Sep. 1, 2006

(86) PCT No.: PCT/JP2006/317345

§ 371 (c)(1),
(2), (4) Date: Dec. 17, 2010

(87) PCT Pub. No.: WO2008/026292

PCT Pub. Date: Mar. 6, 2008

(65) Prior Publication Data

US 2011/0094252 A1 Apr. 28, 2011

(51) Int. Cl.
*F25C 1/00* (2006.01)

(52) U.S. Cl.
USPC ..... 62/347

(58) Field of Classification Search
USPC ..... 62/344, 347, 66, 340, 353
See application file for complete search history.

(56) References Cited

U.S. PATENT DOCUMENTS

| | | | | |
|---|---|---|---|---|
| 3,010,292 | A * | 11/1961 | Newberry | 62/353 |
| 4,787,539 | A * | 11/1988 | Uchida et al. | 222/639 |
| 7,013,657 | B2 * | 3/2006 | Hwang et al. | 62/137 |
| 8,528,351 | B2 * | 9/2013 | An et al. | 62/137 |

FOREIGN PATENT DOCUMENTS

| | | |
|---|---|---|
| JP | 2596320 | 6/1996 |
| JP | H9-159625 | 6/1996 |
| JP | S61-165564 | 7/1996 |
| JP | H11-142033 | 5/1999 |
| JP | 2006-78157 | 3/2006 |
| JP | 2006-118848 | 5/2006 |

* cited by examiner

*Primary Examiner* — Melvin Jones
(74) *Attorney, Agent, or Firm* — DLA Piper LLP (US)

(57) ABSTRACT

A flow-down-type ice making machine in which ice cubes reliably separate and drop from the lower end of an ice making plate, an ice guiding member can be placed close to the ice making plate, and the amount of ice storage is increased. An ice making section (10) is made up of a pair of ice making plates (12, 12) placed opposed to each other in a substantially vertical position and of evaporation tube (14) provided meandering between the ice making plates (12, 12). The ice guiding member (32) attached to an ice making water tank (22) is placed right under and close to the ice making section (10). The ice guiding member (32) is formed in a reverse V-shaped cross-section and is placed so that the top of the ice guiding member is located in the middle between the back sides of the ice making plates (12, 12). A slope (32*a*) tilting from the top of the ice guiding member (32) to one side of the top faces below one ice making plate (12), and a slope (32*a*) tilting from the top of the ice guiding member (32) to the other side of the top faces below the other ice making plate (12). An outwardly projecting lower end projection (20) is formed on each ice making plate (12), at the lower end of its surface facing each ice making region (12) of the ice making plate (12). Because of the presence of the lower end projection (20), an ice cube (M) running onto the lower end projection (20) is separated from an ice making surface.

3 Claims, 3 Drawing Sheets

FLOW-DOWN-TYPE ICE MAKING MACHINE

TECHNICAL FIELD

The present invention relates to a flow down type ice making machine that makes ice cubes at ice making areas of ice making plates having an evaporation tube disposed at the back surfaces thereof by letting ice-making water flow down to the ice making areas.

BACKGROUND ART

As an ice making machine that automatically makes ice cubes, there is known a flow down type ice making machine which has a pair of ice making plates disposed vertically, facing each other and sandwiching an evaporation tube constituting a freezing system, and lets ice-making water flow down to the top surface (ice making surface) of each ice making plate, which is cooled by a coolant to be circulated into the evaporation tube, in an ice making operation to produce ice cubes, and goes to a deicing operation to separate and drop the obtained ice cubes (see, for example, Patent Document 1).

In the deicing operation of the flow down type ice making machine, hot gas is circulatively supplied to the evaporation tube and deicing water of a normal temperature is let to flow down to the back surfaces of the ice making plates to heat the ice making plates, thereby melting ice forming portions between the ice making surface and ice cubes, so that the ice cubes are dropped by the dead weight. An ice guide member which guides ice cubes, separated and dropped from the ice making plates, into an ice storage bin is disposed inclined below the ice making plates, so that deicing water falling down from the ice making plates is collected into an ice-making water tank via through holes provided in the ice guide member. Note that ice-making water which falls down from the ice making plates in the ice making operation is also collected into the ice-making water tank via the through holes in the ice guide member.

Patent Document 1: Japanese Patent Application Laid-Open No. H11-142033

DISCLOSURE OF INVENTION

Problems to be Solved by the Invention

The flow down type ice making machine is configured in such a way that when an ice storage completion switch disposed in the ice storage bin detects ice cubes, production of the ice cubes is stopped, and the level of ice cubes the ice storage completion switch detects is set lower than the ice-making water tank. In the configuration having the ice guide member and ice-making water tank disposed below the ice making plates, as the layout position of the ice guide member is spaced apart downward from the ice making plates, the position of the ice-making water tank is lowered, the amount of ice stored in the ice storage bin which is defined by the ice storage completion switch becomes smaller.

If the ice guide member is arranged close to the lower end of the ice making plate, therefore, when ice cubes produced at the lowermost portion of the ice making plate drop along the ice making surface, the lower end may abut on the ice guide member with the ice cubes partially contacting the ice making surface. In this case, the ice cubes and the ice making surface contact each other in parallel, so that the ice cubes remain unseparated from the ice making surface due to the frictional force, surface tension or the like generated at the contact portions. If ice cubes remain between the ice guide member and the ice making plates this way, the ice cubes may be melted more than necessary, resulting in reduction in the amount of ice made per cycle. In addition, the excessive melting causes uneven reduction or the like of ice cubes, so that ice cubes formed may have a poor appearance. If ice cubes dropping from above are in contact with and caught by ice cubes remaining between the ice guide member and the ice making plate, double ice making may occur. That is, when the ice guide member is placed close to the lower end of the ice making plate, various problems mentioned above arise, so that the configuration makes it difficult to increase the amount of ice stored in the ice storage bin.

Accordingly, the present invention has been proposed to suitably solve the inherent problems of the conventional flow down type ice making machine, and it is an object of the invention to provide a flow down type ice making machine which surely separates and drops ice cubes from the lower end of the ice making plate, can ensure close arrangement of the ice guide member to the ice making plate, and can increase the amount of ice storage.

Means for Solving the Problems

To overcome the problems and suitably achieve the expected object, a flow down type ice making machine according to the present invention has an ice making plate at a back surface of which an evaporation tube, where a coolant is circulatively supplied, is disposed meandering, and which has a plurality of projecting portions extending in an up and down direction and provided at a top surface thereof at predetermined intervals horizontally, wherein ice cubes are produced by letting ice-making water flow down to ice making areas defined by the projecting portions of the ice making plate cooled by circulative supply of the coolant to the evaporation tube, and is characterized in that a lower end projection which separates the ice cubes, separated and dropped from the ice making areas, from the top surface of the ice making plate is provided at a lower end of the top surface of the ice making plate.

According to the present invention, the lower end projection provided at the lower end of the top surface of the ice making plate can surely separate ice cubes from the top surface of the ice making plate. When the ice guide member is arranged close to the ice making plate, therefore, the contact area of an ice cube to the ice making plate when the lower end of the ice cube abuts on the ice guide member is small, so that ice cubes can surely drop. That is, ice cubes are not melted more than necessary, which would otherwise reduce the amount of ice made per cycle, ice cubes with a poor appearance are not produced by excessive melting, and occurrence of double ice making can be prevented, making it possible to increase the amount of ice storage.

The gist of the present invention is that the linear portions of the evaporation tube which extend horizontally are disposed meandering at the back surface of the ice making plate in such a way as to be spaced apart one above another, and a lowermost linear portion is positioned above the lower end projection.

According to the present invention, the lower ends of ice cubes produced in the ice making areas are positioned above the lower end projection, so that at the time the ice cubes are separated and dropped from the ice making plate, the lower ends of the ice cubes ride over the lower end projection to be surely spaced apart from the top surface of the ice making plate.

The gist of the present invention is that projections which separate ice cubes, separated and dropped from the ice making areas, from the top surface of the ice making plate are provided at that top surface of the ice making plate which faces the ice making areas between the vertically spaced-apart linear portions of the evaporation tube.

According to the present invention, ice cubes produced at a position corresponding to the linear portion of the evaporation tube can surely be spaced apart from the top surface of the ice making plate by the projections positioned under the ice cubes, thus achieving smooth separation and dropping of ice cubes.

The gist of the present invention is that an ice guide member, which separates ice-making water to be supplied to the ice making plate in an ice making operation and deicing water to be supplied to ice making plate in a deicing operation from the ice cubes separated and dropped from the ice making plate, and guides the ice cubes M to an ice storage bin, is disposed inclined under the ice making plate, and is disposed close to a lower end of the ice making plate at such a distance therefrom that the ice cubes do not pass between the inclined surface and the lower end of the ice making plate.

According to the present invention, the amount of ice stored in the ice storage bin can be increased by arranging the ice guide member close to the lower end of the ice making plate.

Advantage of the Invention

The flow down type ice making machine according to the present invention allows ice cubes to be surely separated and dropped from the lower end of the ice making plate by the lower end projection provided at the ice making plate, and can ensure close arrangement of the ice guide member to the ice making plate, thus making it possible to increase the amount of ice storage.

DESCRIPTION OF REFERENCE NUMERALS

Figure 1:
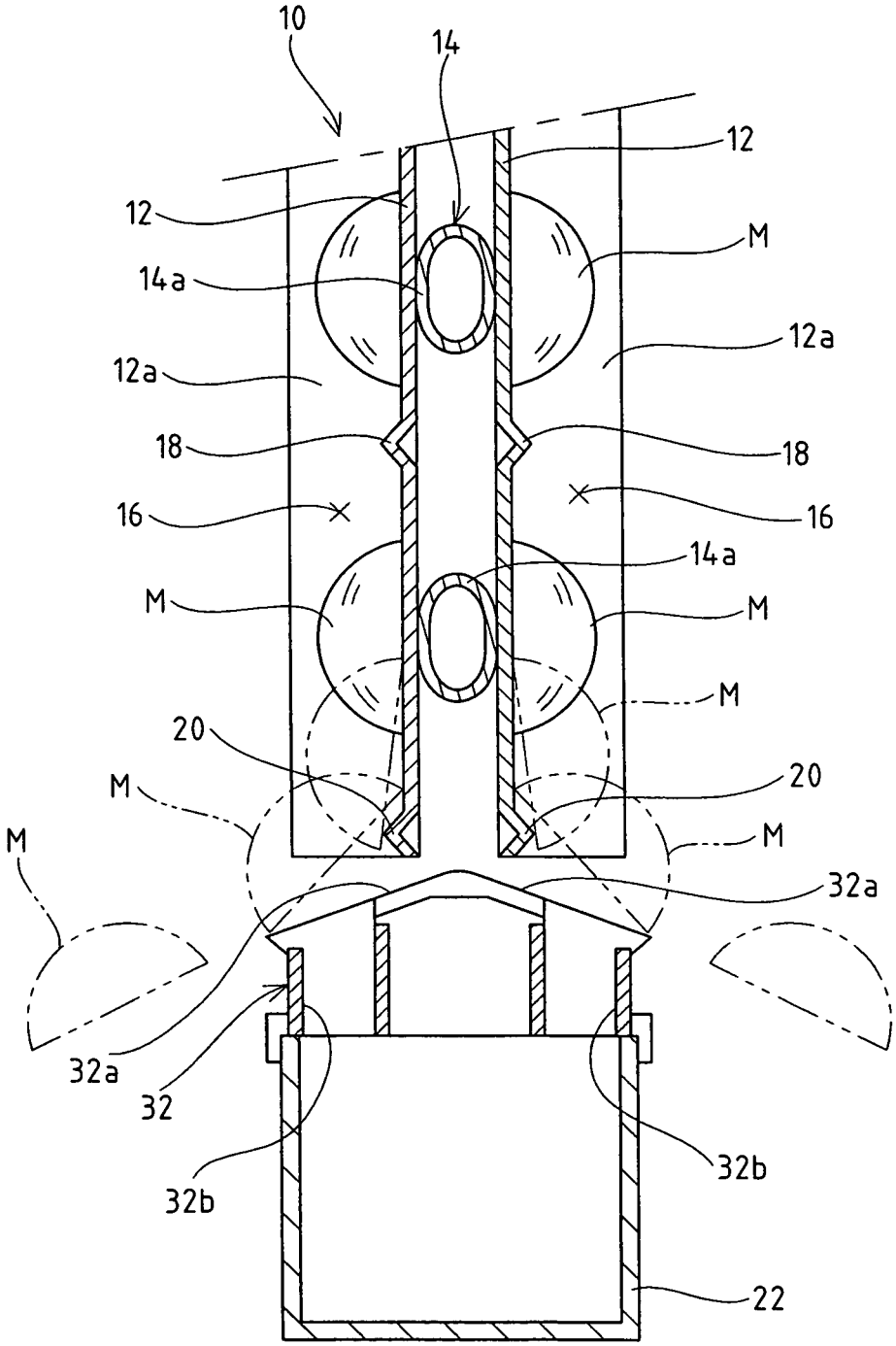
FIG. 1 is a longitudinal cross-sectional side view of essential portions showing an ice making section of a flow down type ice making machine according to an embodiment.

12 ice making plate
12*a* projecting portion
14 evaporation tube
14*a* linear portion
16 ice making area
18 projection
20 lower end projection
32 ice guide member
32*a* inclined surface
M ice cubes

BEST MODE FOR CARRYING OUT THE INVENTION

Next, a flow down type ice making machine according to the present invention will be described below by way of a preferred embodiment referring to the accompanying drawings.

Embodiment

Figure 2:
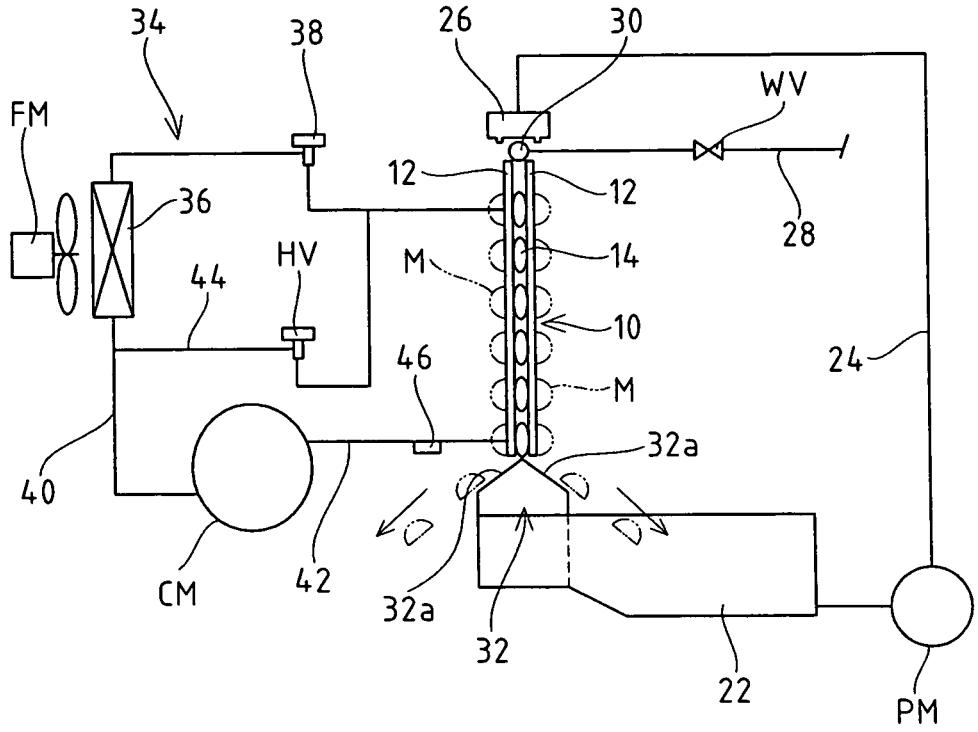
FIG. 2 is a schematic configurational diagram showing the overall flow down type ice making machine according to the embodiment.
Figure 3:
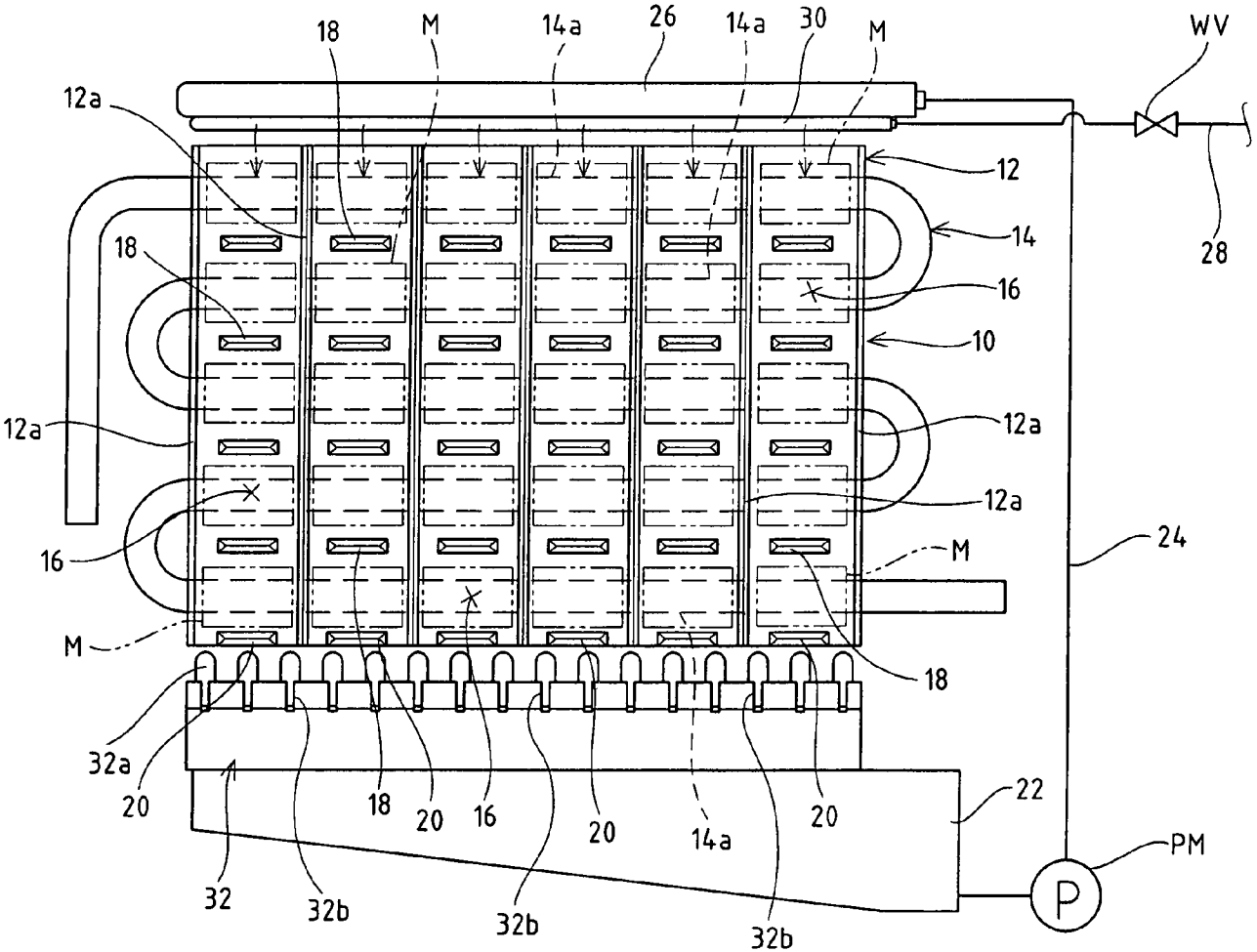
FIG. 3 is a schematic front view of the ice making section according to the embodiment.

FIG. 1 shows essential portions of a flow down type ice making machine according to an embodiment, and FIG. 2 shows the overall flow down type ice making machine. The flow down type ice making machine according to the embodiment has an ice making section 10 disposed above an ice storage bin defined inside a heat-insulating box (neither shown), so that ice cubes M made by the ice making section 10 are discharged and stored in the underlying ice storage bin. The ice making section 10 basically comprises a pair of ice making plates 12, 12 arranged opposite to each other in a substantially vertical state, and an evaporation tube 14 which is disposed between the back surfaces of both ice making plates 12, 12, is formed in a meandering pattern, and into which a coolant is circulatively supplied. As shown in FIG. 3, the evaporation tube 14 has a linear portion 14*a* reciprocally meandering in such a way that the linear portion 14*a* extends horizontally (widthwise direction) of the ice making section 10, and contacts the back surfaces of both ice making plates 12, 12. Then, as a coolant is circulated into the evaporation tube 14 at the time of executing an ice making operation, both ice making plates 12, 12 are compulsively cooled.

A plurality of projecting portions 12*a* extending in an up and down direction are provided on the top surface of the ice making plate 12 (hereinafter also called "ice making surface") at predetermined intervals horizontally, and a pair of projecting portions 12*a*, 12*a* adjoining horizontally define ice making areas 16 extending vertically, as shown in FIG. 3. That is, a plurality of ice making areas 16 are defined in parallel horizontally on the ice making surface side of the ice making plate 12 according to the embodiment.

As shown in FIG. 3, projections 18 projecting outward are formed at the ice making surface facing each ice making area 16 of the ice making plate 12 at approximately middle positions between the linear portions 14*a*, 14*a* of the evaporation tube 14 spaced apart up and down. The bottom surface of the projection 18 which faces the ice making surface is formed to have a horizontally elongated rectangular shape, and to have a triangular cross section with an upper and lower surface being an oblique line as shown in FIG. 1. The projection height of the projection 18 from the ice making surface is set to, for example, about 7 mm or higher, so that ice cubes M rising over the projection 18 are surely separated from the ice making surface.

Lower end projections 20 projecting outward are respectively formed at lower ends of the ice making surfaces (top surfaces) of the ice making plates 12 which face the ice making areas 16, as shown in FIGS. 1 and 3. The shape and the projection height of the lower end projection 20 are the same as those of the projection 18, so that ice cubes M rising over the lower end projections 20 are surely separated from the ice making surface. The lowermost linear portion 14*a* of the evaporation tube 14 is so arranged as to be positioned above the forming position of the lower end projection 20. That is, the configuration is made in such a way that ice cubes M to be produced at the lowermost portion of the ice making areas 16 are positioned on the ice making surface which contacts the lowermost linear portion 14*a* above the forming position of the lower end projection 20.

An ice-making water tank 22 which stores a predetermined amount of ice-making water is disposed under the ice making section 10, and an ice-making water supply tube 24 led out from the ice-making water tank 22 via a circulation pump PM is connected to an ice-making water sprayer 26 provided above the ice making section 10. Multiple spray holes (not shown) are bored through the ice-making water sprayer 26, so that ice-making water pumped out from the ice-making water tank 22 is sprayed onto the ice making surfaces of both ice making plates 12, 12 cooled to the freezing temperature through the spray holes at the time of executing the ice making operation. Then, the ice-making water flowing down on each ice making surface is frozen at those portions of the ice making areas 16 which contact the linear portions 14*a* of the evaporation tube 14, producing ice cubes M of a predetermined shape on the ice making surface.

The illustrated flow down type ice making machine is provided with a deicing-water supply system for spraying water of a normal temperature (hereinafter called "deicing water") on the back surfaces of the ice making plates 12, 12 at the time of the deicing operation and promoting the deicing process with the rising temperature, in addition to the above-described ice-making water supply system. That is, as shown in FIGS. 2 and 3, a deicing water supply tube 28 connected to an external water supply system is connected via a water supply valve WV to a deicing water sprayer 30 provided at the upper portions of the back sides of the ice making plates 12, 12. As the water supply valve WV is opened at the time of executing the deicing operation, deicing water supplied from the external water supply system is sprayed on the back sides of the ice making plates 12, 12 via multiple spray holes (not shown) bored in the deicing water sprayer 30 and flows down on the back sides to accelerate melting of the freezing surface between each ice making plate 12 and ice cubes M.

An ice guide member 32 attached to the upper end portion of the ice-making water tank 22 is disposed close to and directly under the ice making section 10. The ice guide member 32 has a length larger than the width of the ice making section 10, and its cross section in the short side direction (opposing direction of the ice making plates 12, 12) orthogonal to the lengthwise direction is formed angular as shown in FIG. 1. The ice guide member 32 is disposed with respect to the ice making section 10 in such a way that its angular top is at the intermediate position between the back sides of both ice making plates 12, 12, an inclined surface 32*a* inclined downward to one side from the top portion faces below one ice making plate 12, and an inclined surface 32*a* inclined downward to the other side from the top portion faces below the other ice making plate 12, as shown in FIG. 1. That is, each inclined surface 32*a* is inclined downward as it is spaced away form the corresponding ice making plate 12, so that ice cubes M, M separated and dropped from both ice making plates 12, 12 are received at the corresponding inclined surfaces 32*a*, 32*a* in FIG. 1 and are guided to both left and right sides to be stored in the ice storage bin.

A plurality of through holes 32*b* are formed in each inclined surface 32*a* of the ice guide member 32, so that ice-making water supplied to the ice making surfaces of the ice making plates 12, 12 at the time of the ice making operation and deicing water supplied to the back sides of the ice making plates 12, 12 at the time of the deicing operation are collected in the underlying ice-making water tank 22 via the through holes 32*b* of the ice guide member 32. That is, the ice guide member 32 is structured to separate ice cubes M from the ice-making water or deicing water and guide only the ice cubes M into the ice storage bin.

The clearance between each inclined surface 32*a* of the ice guide member 32 and the lower end of the corresponding ice making plate 12 is set to a size which does not permit passage of ice cubes M. That is, as the ice guide member 32 is placed close to the ice making section 10, the ice guide member 32 and the ice-making water tank 22 can be arranged at as upper portions as possible, so that the amount of ice cubes M storable in the ice storage bin defined under can be increased.

As shown in FIG. 2, a freezing apparatus 34 of the flow down type ice making machine comprises a compressor CM, a condenser 36, an expansion valve 38 and the evaporation tube 14 connected to in the named order by coolant tubes 40, 42. At the time of the ice making operation, a vapor coolant compressed by the compressor CM travels through the discharge tube (coolant tube) 40 to the condenser 36 to be condensed and liquefied, is depressurized by the expansion valve 38, and flows into the evaporation tube 14 to be expanded and vaporized at once for heat exchange with the ice making plates 12, 12 to cool the ice making plates 12, 12 down to below the freezing temperature. The vapor coolant vaporized in the evaporation tube 14 repeats a cycle of being fed back to the compressor CM through the suction tube (coolant tube) 42 and supplied to the condenser 36 again. The freezing apparatus 34 has a hot gas tube 44 which is branched from the discharge tube 40 of the compressor CM, and is connected to the inlet side of the evaporation tube 14 via a hot gas valve HV. The hot gas valve HV is controlled in such a way that it is closed at the time of the ice making operation, and is opened at the time of the deicing operation. At the time of the deicing operation, the hot gas discharged from the compressor CM is bypassed to the evaporation tube 14 via the opened hot gas valve HV and the hot gas tube 44 to heat the ice making plates 12, 12, thereby melting the ice forming surfaces of ice cubes M produced on the ice making surface, so that the ice cubes M drop by the dead weight. That is, with the compressor CM in operation, as the opening/closing of the hot gas valve HV is controlled, the ice making operation and the deicing operation are repeated alternately, making ice cubes M. Reference numeral FM in the diagram indicates a fan motor which is operated (ON) at the time of the ice making operation to air-cool the condenser 36.

A temperature sensing section of a temperature sensor 46, such as a thermistor, as temperature detection means for detecting the outlet temperature of the coolant after heat exchange with the ice making plates 12, 12 is disposed in close to the suction tube 42 connected to the coolant outlet side of the evaporation tube 14. Control is performed in such a way that when the temperature sensor 46 detects a preset deicing completion temperature, the deicing operation is stopped and is switched to the ice making operation. Control is performed in such a way that the ice making operation is stopped and is switched to the deicing operation on condition that a float switch (not shown) detects that the water level in the ice-making water tank 22 drops to a specified water level after the ice making operation is started. An ice storage completion switch (not shown) which detects that the ice storage bin is full with ice cubes M is disposed in the ice storage bin, so that when the ice storage completion switch detects ice cubes M being stored up to a predetermined level in the ice storage bin, production of the ice cubes M in the ice making section 10 is stopped. The production of the ice cubes M in the ice making section 10 is resumed on condition that ice cubes M are removed from the ice storage bin, lowering the ice storage level, and the ice storage completion switch no longer detects ice cubes M.

Operation of Embodiment

Next, the operation of the flow down type ice making machine according to the embodiment will be described.

In the ice making operation, the circulation pump PM is activated and ice-making water stored in the ice-making water tank 22 is supplied via the ice-making water sprayer 26 to the individual ice making areas 16 of both of the ice making plates 12, 12. The ice making plates 12, 12 exchange heat with the coolant circulating in the evaporation tube 14 to be compulsively cooled, and ice-making water supplied to the ice making areas 16 of the ice making plates 12, 12 start gradually being frozen at the contact portions where the water contacts the linear portion 14*a* of the evaporation tube 14. The ice-making water which drops from the ice making plates 12, 12 without being frozen is collected in the ice-making water tank 22 via the through holes 32*b* of the ice guide member 32, and is supplied to the ice making plates 12, 12 again.

When a predetermined time elapses and the float switch detects the specified water level, the ice making operation is terminated, and the deicing operation is started. When the ice making operation is complete, as shown in FIG. 3, a plurality of ice cubes M are produced, spaced apart in the up and down direction in correspondence to the contact portions of the linear portion 14*a* of the evaporation tube 14 with the ice making plate 12, in the ice making areas 16 of the ice making plate 12. The ice making operation is set to be completed so that ice cubes M have a size not to contact the projections 18 or the lower end projections 20.

As the deicing operation starts, the hot gas valve HV is opened to circulate the hot gas to the evaporation tube 14, and the water supply valve WV is opened to supply deicing water to the back sides of the ice making plates 12, 12 via the deicing water sprayer 30, thereby heating the ice making plates 12, 12 to melt the freezing surface with the ice cubes M. Note that the deicing water flowing down on the back sides of the ice making plates 12, 12, like the ice-making water, is collected in the ice-making water tank 22 via the through holes 32*b* of the ice guide member 32, and is used as ice-making water next time.

When the ice making plate 12 is heated by the deicing operation, the freezing surface between ice cubes M and the ice making plate 12 is melted, so that the ice cubes M start sliding down on the ice making plate 12. At this time, the ice cubes M are in contact with the ice making surfaces and the projecting portions 12*a*, 12*a*, and slowly slide down due to the frictional force or surface tension. When the ice cubes M reach the underlying projections 18, the ice cubes M ride over the projections 18, so that the ice cubes M are surely spaced apart and separated from the ice-making surface of the ice making plate 12. The ice cubes M separated and dropping from the ice making plate 12 are received at the inclined surface 32*a* of the ice guide member 32, and slide down along the inclined surface to be guided into the ice storage bin. In the embodiment, ice cubes M dropping from both ice making plates 12, 12 of the ice making section 10 are guided in the mutually opposing directions by the inclined surfaces 32*a*, 32*a* of the ice guide member 32, and are stored dispersed in a wide range in the ice storage bin.

How ice cubes M produced at the lowermost portion of the ice making plate 12 are separated and dropped from the ice making plate 12 will be elaborated below. When the ice making plate 12 is heated to melt the freezing surfaces of the ice making plate 12 in the deicing operation, the ice cubes M at the lowermost portion start sliding down on the ice making plate 12 too. Then, as the lower ends of the ice cubes M ride over the lower end projection 20, the ice cubes M are surely separated from the ice making plate 12. In this case, the inclined surface 32*a* of the ice guide member 32 is close to the lower end of the ice making plate 12, so that as shown in FIG. 1, with the ice cubes M at the lowermost portion riding over the lower end projection 20, the lower ends of the ice cubes M may abut on the inclined surface 32*a* of the ice guide member 32. The ice cubes M at the lowermost portion are almost separated from the ice making surface of the ice making plate 12 to make the contact areas very small at this time, however, the frictional force or surface tension acting on the ice cubes M at the lowermost portion are reduced significantly as compared with the prior art, so that the ice cubes M do not remain between the ice guide member 32 and the ice making plate 12 and are surely separated from the ice making plate 12.

That is, even when the ice guide member 32 is arranged close to the ice making plate 12, ice cubes M at the lowermost portion can be prevented from staying between the ice guide member 32 and the ice making plate 12. This makes it possible to prevent the amount of ice made per cycle from being reduced by melting of ice cubes M more than necessary, or prevent production of ice cubes M having a poor appearance. Because ice cubes M do not remain between the ice guide member 32 and the ice making plate 12, it is possible to prevent double ice making which would otherwise be caused by piling of ice cubes M dropping from above.

When all the ice cubes M are separated from the ice making plates 12, 12 and the temperature sensor 46 detects the deicing completion temperature due to a rise in the temperature of the hot gas, the deicing operation is terminated, after which the ice making operation is started to repeat the foregoing ice making-deicing cycle. When the ice storage completion switch detects that ice cubes M are stored to a predetermined level in the ice storage bin, production of ice cubes M in the ice making section 10 is stopped. In this case, the ice storage level of ice cubes M in the ice storage bin which is defined by the ice storage completion switch is restricted by the layout position of the ice-making water tank 22. In the flow down type ice making machine according to the embodiment, the ice guide member 32 attached to the ice-making water tank 22 can be arranged as close to the lower end of the ice making plate 12 as possible as mentioned above, making it possible to dispose the ice-making water tank 22 above the ice storage bin and spaced apart therefrom. Therefore, the ice storage level of ice cubes M in the ice storage bin which is defined by the ice storage completion switch can be set high, making it possible to increase the ice storage amount of the ice storage bin.

Modifications

The present application is not limited to the structure of the foregoing embodiment, and other structures can be adopted as needed.

1. Although the foregoing description of the embodiment has been given of the case where the lower end projection is shaped to have a rectangular bottom surface and have a triangular cross section, it can take any shape which separates ice cubes from the ice making surface. For example, the bottom surface may take a square shape or an elliptical shape, or the cross section may be arcuate or may take other various kinds of shapes. A plurality of lower end projections may be provided, spaced apart from one another horizontally, in one ice making area.
2. Although the lower end projection is formed integrally with the ice making plate in the embodiment, a lower end projection formed separately may be provided at the ice making plate. Likewise, projections may be structured in such a way that projections formed separately may be provided at the ice making plate.
3. Although the ice guide member has an angular cross section as one example in the embodiment, ice guide members corresponding to the individual ice making plates may be structured separately and arranged inclined.
4. Although the foregoing description of the embodiment has been given of the case where the ice making section is configured to have a pair of ice making plates arranged facing each other with the evaporation tube in between, the evaporation tube 14 may be arranged meandering at the back surface of a single ice making plate, for example. In this case, the ice guide member should have an inclined surface formed which is inclined to one side only.

The invention claimed is:

1. A flow down type ice making machine having an ice making plate at a back surface of which an evaporation tube where a coolant is circulatively supplied is disposed meandering, and which has a plurality of projecting portions extending in an up and down direction and provided at a top surface thereof at predetermined intervals horizontally, wherein ice cubes are produced by letting ice-making water flow down to ice making areas defined by the projecting portions of the ice making plate cooled by circulative supply of the coolant to the evaporation tube, characterized in that a lower end projection which separates the ice cubes, separated and dropped from the ice making areas, from the top surface of the ice making plate is provided at a lower end of the top surface of the ice making plate, and linear portions of the evaporation tube which extend horizontally are disposed meandering at the back surface of the ice making plate in such a way as to be spaced apart one above another, and a lowermost linear portion is positioned above the lower end projection.

2. The flow down type ice making machine according to claim 1, wherein projections which separate ice cubes, separated and dropped from the ice making areas, from the top surface of the ice making plate are provided at that top surface of the ice making plate which faces the ice making areas between the vertically spaced-apart linear portions of the evaporation tube.

3. The flow down type ice making machine according to claim 1, wherein an ice guide member, which separates ice-making water to be supplied to the ice making plate in an ice making operation and deicing water to be supplied to ice making plate in a deicing operation from the ice cubes separated and dropped from the ice making plate, and guides the ice cubes to an ice storage bin, is disposed inclined under the ice making plate, and is disposed close to a lower end of the ice making plate at such a distance therefrom that the ice cubes do not pass between the inclined surface and the lower end of the ice making plate.

* * * * *